US010443022B2

(12) United States Patent
Wrubbel et al.

(10) Patent No.: US 10,443,022 B2
(45) Date of Patent: Oct. 15, 2019

(54) SOLID FABRIC CARE COMPOSITION WITH A POLYSACCHARIDE

(71) Applicant: Henkel AG & Co. KGaA, Duesseldorf (DE)

(72) Inventors: Noelle Wrubbel, Duesseldorf (DE); Karl-Heinz Scheffler, Duesseldorf (DE); Daniel Tigges, Duesseldorf (DE); Rene-Andres Artiga Gonzalez, Duesseldorf (DE); Matthias Sunder, Duesseldorf (DE); Mario Sturm, Leverkusen (DE); Tobias Segler, Duesseldorf (DE); Konstanze Mayer, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/368,983

(22) Filed: Dec. 5, 2016

(65) Prior Publication Data

US 2017/0081612 A1 Mar. 23, 2017

Related U.S. Application Data

(60) Division of application No. 12/966,124, filed on Dec. 13, 2010, now abandoned, which is a continuation of application No. PCT/EP2009/057757, filed on Jun. 23, 2009.

(30) Foreign Application Priority Data

Jul. 3, 2008 (DE) ..... 10 2008 031 212
Sep. 12, 2008 (DE) ..... 10 2008 047 233

(51) Int. Cl.

| | |
|---|---|
| ***C11D 3/00*** | (2006.01) |
| ***C11D 17/00*** | (2006.01) |
| ***C11D 3/37*** | (2006.01) |
| ***C11D 11/00*** | (2006.01) |
| ***C11D 3/50*** | (2006.01) |
| ***C11D 9/26*** | (2006.01) |
| ***C11D 17/06*** | (2006.01) |

(52) U.S. Cl.

CPC ..... *C11D 3/505* (2013.01); *C11D 3/001* (2013.01); *C11D 3/3707* (2013.01); *C11D 3/50* (2013.01); *C11D 9/262* (2013.01); *C11D 11/0017* (2013.01); *C11D 17/0039* (2013.01); *C11D 17/06* (2013.01)

(58) Field of Classification Search

None

See application file for complete search history.

(56) References Cited

U.S. PATENT DOCUMENTS

| | | | | |
|---|---|---|---|---|
| 4,533,562 | A * | 8/1985 | Ikegami | A61K 9/284 424/494 |
| 6,376,454 | B1 | 4/2002 | Eggersmann et al. | |
| 2002/0034549 | A1 | 3/2002 | Becker et al. | |
| 2003/0180340 | A1* | 9/2003 | Birch | C11D 3/505 424/401 |
| 2005/0176599 | A1* | 8/2005 | Bergquist | C11D 1/62 510/101 |
| 2009/0042766 | A1* | 2/2009 | Mayer | C11D 3/001 510/516 |
| 2009/0156454 | A1* | 6/2009 | Schmiedel | C11D 3/38672 510/302 |
| 2011/0152146 | A1* | 6/2011 | Denutte | A61K 8/11 510/119 |

FOREIGN PATENT DOCUMENTS

| | | | |
|---|---|---|---|
| WO | WO2007113326 | A1 | 10/2007 |
| WO | WO2007115872 | A1 | 10/2007 |

OTHER PUBLICATIONS

PCT International Search Report (PCT/EP2009/057757) dated Jun. 8, 2009.

* cited by examiner

*Primary Examiner* — Katie L. Hammer
(74) *Attorney, Agent, or Firm* — Thomas G. Krivulka

(57) ABSTRACT

The present invention is a solid fabric care composition comprising a water-soluble carrier, a water-soluble polymer, a fabric care compound, a polysaccharide and a fragrance, wherein the water-soluble carrier is in particle form, having a coating comprising the water-soluble polymer and the fragrance, and a mixture of the fabric care compound and the polysaccharide being incorporated at least partly into the coating, or the coating of the water-soluble carrier being coated at least partly with a mixture of the fabric care compound and the polysaccharide. Also described herein are fabric care washing or cleaning products comprising the fabric care compositions.

1 Claim, No Drawings

SOLID FABRIC CARE COMPOSITION WITH A POLYSACCHARIDE

CROSS-REFERENCE TO RELATED APPLICATIONS

This application is a divisional application of co-pending U.S. application Ser. No. 12/966,124, which is a continuation of PCT Application Serial No. PCT/EP2009/057757, filed on Jun. 23, 2009, which claims priority under 35 U.S.C. § 119 to 10 2008 031 212.6 (DE), filed on Jul. 3, 2008, and to 10 2008 047 233.6 (DE) filed on Sep. 12, 2008. The disclosures PCT/EP2009/057757, DE 10 2008 031 212.6, and DE 10 2008 047 233.6 are hereby incorporated by reference in their entirety.

FIELD OF THE INVENTION

The present invention relates to a solid textile care composition and the use and production thereof. In addition, the invention relates to a detergent or cleaning agent containing the solid textile care composition.

BACKGROUND OF THE INVENTION

Textiles often become hard and lose their softness with repeated washing. To restore softness and flexibility to textiles and to impart fragrance and antistatic properties, textiles are often treated with a fabric softener in a separate rinsing operation conducted after the actual washing and cleaning process.

Most commercial fabric softeners are aqueous compositions comprising a cationic textile softening compound having one or two long-chain alkyl groups. For example, cationic softeners may comprise methyl-N-(2-hydroxyethyl)-N,N-di(tallow acyloxyethyl) ammonium compounds or N,N-dimethyl-N,N-di(tallow acyloxyethyl) ammonium compounds.

Such cationic fabric conditioning compounds cannot be used in the wash cycle with detergents that contain anionic surfactants because of the interaction between the cationic conditioner and anionic surfactant. In this case, a separate rinse cycle with the cationic conditioner is required, which may be time and energy intensive.

A further disadvantage of conventional cationic fabric softeners is that they do not prevent deposition of lime scale on the laundered fabrics during the rinse cycle. In addition, cationic softeners often leave behind unsightly deposits in the dispensing tray of washing machines.

Problems may also occur with other fabric conditioners that need to be dosed separately and/or need to be used in a separate rinse cycle.

Solid fabric treatment agents in granular form have been described in the prior art. For example, PCT Application Publication WO2007/115872 (Artiga-Gonzalez, et al.) discloses a granular fabric treatment agent comprising a water-soluble carrier having a coating comprising a water-soluble polymer and fragrance, where the coating is at least partially coated with a fabric care compound.

However, such granular products may agglomerate during production and storage due to an inherent "stickiness," giving rise to processing problems and consumer dosing problems.

What is still lacking in the art is a free-flowing solid fabric treatment agent containing a water-soluble carrier that further comprises a water-soluble polymer, a fragrance, and a fabric care compound, which does not agglomerate or clump during production and storage.

SUMMARY OF THE INVENTION

In an exemplary embodiment of the present invention, a solid fabric care composition is described that comprises a water-soluble carrier, a water-soluble polymer, a fabric care compound, a polysaccharide, and a perfume, where the water-soluble carrier is present as a particulate and at least partially possesses a coating comprising water-soluble polymer and perfume. A laundry rinse additive of this type may be incorporated in the main wash cycle of an automatic washing machine process. The fabric care composition may be added together with the washing/cleaning agent in the drum of the washer or in the dispensing drawer. The advantage of the present invention is that no additional rinse cycle is required and no unsightly deposits appear in the dispensing compartment of the washer.

In another exemplary embodiment of the present invention, a solid fabric care composition is described that comprises a water-soluble carrier, a water-soluble polymer, a fabric care compound, a polysaccharide, and a perfume, where the water-soluble carrier is present as a particulate and at least partially possesses a coating comprising water-soluble polymer and perfume, and where a mixture of the fabric care compound and the polysaccharide is partially present in, and/or at least partially on, the coating.

In another exemplary embodiment of the present invention, it has been surprisingly found that the inherent stickiness of a granulated fabric treatment agent can be prevented if the coating on the particles comprises a mixture of fabric care compound and a polysaccharide. Particles coated in this manner did not show any tendency to clump or agglomerate either during production or during storage. In addition, such coated fabric treatment agents remain free-flowing. Furthermore it has been shown that freshly produced fabric treatment agent particles can be filled at higher temperatures, resulting in shorter filling times.

In another exemplary embodiment of the present invention, fabric treatment particles with a coating comprising the fabric care compound and a polysaccharide retain a crystalline visual appearance longer.

In another exemplary embodiment of the present invention, the solid fabric care may be used to condition textile fabrics. To that end, the composition may be introduced in the wash cycle of a laundry cleaning process wherein the fabric care compound and the perfume may be directly transported to the laundry at the start of the washing process in order to develop the full potential of these actives. Moreover, the solid composition of the present invention is easier to handle than liquid fabric conditioners that lead to messes on and around the bottle from dripping/spillage. The dry granular form of the present invention allows for easier cleanup of spillage.

DETAILED DESCRIPTION OF THE INVENTION

The present invention is a solid fabric treatment agent that comprising a water-soluble carrier, a water-soluble polymer, a fabric care compound, a polysaccharide, and a perfume, where the carrier is a particulate that at least partially possesses a coating comprising the water-soluble polymer and perfume, and where a mixture of the fabric care compound and the polysaccharide is partially present in, and/or at least partially on, the coating.

The water-soluble carrier is preferably selected from the group consisting of inorganic alkali metal salts, organic alkali metal salts, inorganic alkaline earth metal salts, organic alkaline earth metal salts, organic acids, carbohydrates, silicates, and urea, and mixtures thereof.

These materials are not only inexpensive but tend to be highly soluble in water. Moreover, these materials are virtually odorless.

The solid fabric care compositions of the present invention may comprise from 50 wt. % to 99 wt. % of the water-soluble carrier. Preferably, the present invention comprises from 75 wt. % to 95 wt. % water-soluble carrier.

The fabric care composition of the present invention preferably comprises a fabric care compound selected from the group consisting of fabric-softening compounds, bleaching agents, bleach activators, enzymes, silicone oils, anti-redeposition agents, optical brighteners, graying inhibitors, shrink inhibitors, anti-creasing agents, color transfer inhibitors, antimicrobials, germicides, fungicides, antioxidants, antistats, ironing aids, water proofing agents, impregnation agents, swelling agents, anti-slip agents, and UV absorbers, and mixtures thereof.

Preferably the fabric care compound comprises a fabric softener. It is most preferred that the fabric softening compound is selected from the group consisting of polysiloxanes, fabric softening clays, and cationic polymers, and mixtures thereof.

The use of polysiloxanes and/or cationic polymers as the fabric care compounds for the present invention is desirable in that they not only show a softening effect, but also reinforce the impression of the perfume of the laundry. The use of softening clays as the fabric care compound in the present invention is also desirable in that they show a water-softening effect, thus mitigating lime scale deposits on the laundry. In order to optimize the performance of the fabric care composition, the present invention may include a combination of at least two of these fabric care compounds described above.

The water-soluble polymer is preferably selected from the group consisting of polyalkylene glycols, polyethylene terephthalates, and polyvinyl alcohols, and mixtures thereof. These water-soluble polymers tend to act as binders.

The particle size of the water-soluble carrier is preferably in the range of 0.6 to 30 mm, particularly from 0.8 to 7 mm, and most preferably from 1 to 3 mm.

Fabric care compositions with particle size in the range of 0.8 to 7 mm, and most preferably from 1 to 3 mm, may be dosed in a controlled manner.

The polysaccharide for use in the present composition is preferably selected from the group consisting of glycogen, starch, chitin, callose, cellulose, dextran, tunicin, inulin, alginic acid, xanthane, gellan, guar, carob flour, carrageenan, and derivatives of these compounds, and mixtures thereof.

It is particularly preferred that the polysaccharide for use herein is cellulose or a cellulose derivative selected from the group consisting of methyl cellulose, ethyl cellulose, propyl cellulose, methyl ethyl cellulose, carboxymethyl cellulose, ethyl carboxymethyl cellulose, hydroxyethyl cellulose, hydroxypropyl cellulose, carboxymethyl hydroxyethyl cellulose, methyl hydroxyethyl cellulose, hydroxypropyl methyl cellulose, ethyl hydroxyethyl cellulose, methyl ethyl hydroxyethyl cellulose, quaternized cellulose, quaternized cellulose derivatives, amine-modified cellulose, and amine-modified cellulose derivatives, and mixtures thereof.

Cellulose and cellulose derivatives are particularly effective for preventing an adhesion of the particles of the fabric treatment agent. It has also been shown that cellulose or its derivatives increase the color stability of colored solid fabric care compositions.

The compositions of the present invention may comprise additional ingredients to improve the application and/or aesthetic properties. For example, the present compositions may also comprise colorants, fillers, pearlizers, skin care compounds, bittering agents or mixtures of these additives.

In a preferred embodiment of the present invention, the fabric care composition comprises from 0.1 wt. % to 15 wt. %, particularly from 1 wt. % to 10 wt. %, and most preferably from 2 wt. % to 7 wt. % of a perfume.

Conventional liquid fabric softeners based on quaternary ammonium compounds have stability issues when high levels of perfume (e.g. >0.4 wt. % in a standard liquid and >1.0 wt. % in a concentrated product) are incorporated. On the other hand, the present invention allows for higher amounts of perfume, (e.g. >1.0 wt. %) to be incorporated without difficulty.

In a particularly preferred embodiment of the present invention, a mixture comprising the fabric care compound and the polysaccharide is at least partially incorporated into the coating. In this embodiment, the advantages discussed above (no clumping/agglomerating, color stability, retention of crystalline visual appearance, improved flow, etc.) are particularly strongly pronounced.

In an alternative embodiment, the coating or the coating and the uncoated areas of the water-soluble carrier are at least partially coated with a mixture of the fabric care compound and the polysaccharide.

The present invention also relates to the use of a solid fabric care composition for the conditioning of textile fabrics.

Moreover, the present invention relates to a process for manufacturing a solid fabric care composition comprising a water-soluble carrier, a water-soluble polymer, a fabric care compound, a polysaccharide, and a perfume, where the process comprises the steps of (1) melting the water-soluble polymer, (2) mixing the perfume into the melt, (3) adding the polymer/perfume molten mixture to the particulate carrier such that the carrier is at least partially coated, followed by (4) incorporation of the fabric care compound and polysaccharide mixture into the still-molten coating.

The present invention further relates to a washing or cleaning agent containing a solid fabric care composition as described herein.

By incorporating the inventive fabric care composition into a washing or cleaning agent, a fabric care washing or cleaning agent ("2 in 1" washing or cleaning agent) is provided to the consumer, who does not need to dose two compositions. Thus, by incorporating a fabric softening composition into a washing or cleaning agent, a fabric softening washing or cleaning agent ("2 in 1" washing or cleaning agent) is provided to the consumer, who needs neither to dose two compositions nor needs a separate rinse cycle.

Furthermore, the washing or cleaning agent and the fabric care composition do not need to be both scented. Instead, only one of the two compositions, preferably the fabric care composition, needs to be scented. This not only results in lower cost but has advantages for consumers with sensitive skin and/or allergies.

The present invention is described in more detail inter alia by means of examples.

The solid fabric care composition of the present invention minimally comprises a water-soluble carrier, a water-soluble polymer, a fabric care compound, a polysaccharide, and a perfume.

One essential ingredient of the present invention is the water-soluble carrier. The water-soluble carrier preferably comprises: inorganic alkali metal salts such as sodium chloride, potassium chloride, sodium sulfate, sodium carbonate, potassium sulfate, potassium carbonate, sodium hydrogen carbonate, potassium hydrogen carbonate or mixtures thereof; organic alkali metal salts such as sodium acetate, potassium acetate, sodium citrate, sodium tartrate or potassium sodium tartrate; inorganic alkaline earth metal salts such as calcium chloride, magnesium sulfate or magnesium chloride; organic alkaline earth metal salts such as calcium lactate, carbohydrates, organic acids such as citric acid or tartaric acid, silicates such as water glass, sodium silicate or potassium silicate, and urea, as well as mixtures thereof. The water-soluble carrier may comprise a carbohydrate selected from the group consisting of dextrose, fructose, galactose, isoglucose, glucose, sucrose, raffinose, isomalt, and xylitol, and mixtures thereof. For example, the carbohydrate may be candy sugar or coarse sugar.

As carriers, carbohydrates have the advantage that they do not promote corrosion of the metallic parts within an automatic wash machine. Utilizing citric acid as the carrier brings in a builder for reducing water hardness.

The water-soluble carrier may also comprise mixtures of the materials discussed above.

Preferably the water-soluble carrier is a particulate having particle size from 0.6 to 30 mm, more preferably from 0.8 to 7 mm, and most preferably from 1 to 3 mm.

Herein, a fabric care compound refers to a compound that provides a beneficial effect to textile fabrics, such effects that may include, but are not limited to, fabric softening, crease resistance, and reduction of damaging/negative effects that may arise on cleaning and/or conditioning and/or wearing fabrics, such as fading, graying, etc.

For example, the fabric care compound may contain fabric-softening compounds, bleaching agents, bleach activators, enzymes, silicone oils, anti-redeposition agents, optical brighteners, graying inhibitors, shrink inhibitors, anticreasing agents, color transfer inhibitors, antimicrobials, germicides, fungicides, antioxidants, antistats, ironing aids, water proofing and impregnation agents, swelling and antislip agents, and UV absorbers, and mixtures thereof. Specific examples of these fabric care compounds are discussed below in the context of washing or cleaning agents in accordance with the present invention, and these examples may also be used in the solid, fabric care composition.

The fabric care compound is preferably a fabric softening compound comprising a polysiloxane, a fabric softening clay, a cationic polymer, or a mixture of at least two of these materials. Accordingly, the fabric care composition is preferably a fabric softening composition.

Polysiloxanes that find use in the present invention as the fabric care compound minimally possess the following structural units:

a)

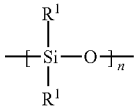

wherein R1=independently of each other $C_1$-$C_{30}$ alkyl, preferably $C_1$-$C_4$ alkyl, in particular methyl or ethyl, n=1 to 5000, preferably 10 to 2500, in particular 100 to 1500.

It is also preferred that the polysiloxane possess the following additional structural units:

b)

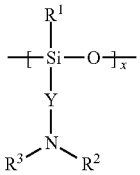

wherein $R^1$=independently of each other $C_1$-$C_{30}$ alkyl, preferably $C_1$-$C_4$ alkyl, in particular methyl or ethyl, Y=optionally substituted, linear or branched $C_1$-$C_{20}$ alkylene, preferably —$(CH_2)_m$— with m=1 to 16, preferably 1 to 8, in particular 2 to 4, especially 3, $R^2$, $R^3$=independently of one another H or optionally substituted, linear or branched $C_1$-$C_{30}$ alkyl, preferably $C_1$-$C_{30}$ alkyl substituted with amino groups, particularly preferably —$(CH_2)_b$—$NH_2$ where b is 1 to 10, most preferably b=2, x=1 to 5000, preferably 10 to 2500, especially 100 to 1500.

If the polysiloxane used herein only possesses the structural units identified by (a) above, with $R^1$=methyl, then the material is a polydimethylsiloxane. Such materials are known to be efficient fabric care compounds.

Suitable polydimethysiloxanes include DC-200 (ex Dow Corning), Baysilone® M 50, Baysilone® M 100, Baysilone® M 350, Baysilone® M 500, Baysilone® M 1000, Baysilone® M 1500, Baysilone® M 2000 or Baysilone® M 5000 (all ex GE Bayer Silicones).

The polysiloxane may also comprise both the structural units (a) and (b) indicated above. Such preferred siloxanes possess the following structure: $(CH_3)_3Si$—$[O—Si(CH_3)_2]_n$—$[O—Si(CH_3)\{(CH_2)_3—NH—(CH_2)_2—NH_2\}]_x$—$OSi(CH_3)_3$, wherein the sum of n+x is a number between 2 and 10,000.

Suitable polysiloxanes with the structural units indicated as (a) and (b) above are commercially available under the brand names DC2-8663, DC2-8035, DC2-8203, DC05-7022 or DC2-8566 (all from Dow Corning). The commercially available products Dow Corning® 7224, Dow Corning® 929 Cationic Emulsion or Formasil 410 (GE Silicones) are likewise suitable in accordance to the present invention.

An example of fabric softener clay for use in the present composition is smectite clay. Preferred smectite clays are Beidellite clays, Hectorite clays, Laponite clays, montmorillonite clays, Nontronite clays, Saponite clays, Sauconite clays and mixtures thereof. Montmorillonite clays are the preferred softening clays. Bentonites comprise mainly montmorillonites and can serve as the preferred source for the fabric-softening clay. The Bentonites can be employed as a powder or as crystals.

Suitable Bentonites include clays marketed under the trade names Laundrosil® from Süd-Chemie or under the trade name Detercal® from Laviosa. The fabric care composition herein preferably comprises a powdered Bentonite as the fabric care compound.

Suitable cationic polymers for use herein as the fabric care compound include those described in "CTFA International Cosmetic Ingredient Dictionary", Fourth Edition, J. M. Nikitakis, et al, Editors, published by the Cosmetic, Toiletry, and Fragrance Association, 1991 and grouped under the general term "polyquaternium". Some examples of suitable polyquaternium compounds are listed below in more detail:

POLYQUATERNIUM-1 (CAS-Number: 68518-54-7)

Definition: $\{(HOCH_2CH_2)_3N^+—CH_2CH=CHCH_2—[N^+(CH_3)_2—CH_2CH=CHCH_2]_x—N^+(CH_2CH_2OH)_3\}[Cl^-]_{x+2}$ POLYQUATERNIUM-2 (CAS-Number: 63451-27-4)

Definition: $[—N(CH_3)_2—CH_2CH_2CH_2—NH—C(O)—NH—CH_2CH_2CH_2—N(CH_3)_2—CH_2CH_2OCH_2CH_2—]^{2+}(Cl^-)_2$

POLYQUATERNIUM-3

Definition: copolymer of acrylamide and trimethylammoniumethyl methacrylate methosulfate.

POLYQUATERNIUM-4 (CAS-Number: 92183-41-0)

Definition: copolymer of hydroxyethyl cellulose and diallyldimethylammonium chloride, available, for example, as Celquat® H 100 or Celquat® L200 (from National Starch).

POLYQUATERNIUM-5 (CAS-Number: 26006-22-4)

Definition: copolymer of acrylamide and β-methacrylyloxyethyltrimethylammonium methosulfate.

POLYQUATERNIUM-6 (CAS-Number: 26062-79-3)

Definition: polymer of dimethyldiallylammonium chloride.

POLYQUATERNIUM-7 (CAS-Number: 26590-05-6)

Definition: polymeric quaternary ammonium salt consisting of acrylamide and dimethyldiallylammonium chloride monomers.

POLYQUATERNIUM-8

Definition: polymeric quaternary ammonium salt of methyl and stearyl dimethylaminoethyl methacrylate, quaternized with dimethyl sulfate.

POLYQUATERNIUM-9

Definition: polymeric quaternary ammonium salt of polydimethylaminoethyl methacrylate, quaternized with methyl bromide.

POLYQUATERNIUM-11 (CAS-Number: 53633-54-8)

Definition: quaternary ammonium polymer formed by reacting vinyl pyrrolidone and dimethylaminoethyl methacrylate copolymer with diethyl sulfate.

POLYQUATERNIUM-12 (CAS-Number: 68877-50-9)

Definition: quaternary ammonium polymer salt, obtained by reacting ethyl methacrylate/abietyl methacrylate/diethylaminoethyl methacrylate copolymer with dimethyl sulfate.

POLYQUATERNIUM-13 (CAS Number: 68877-47-4)

Definition: polymeric quaternary ammonium salt, obtained by reacting ethyl methacrylate/oleyl methacrylate/diethylaminoethyl methacrylate copolymer with dimethyl sulfate.

POLYQUATERNIUM-14 (CAS-Number: 27103-90-8)

Definition: polymeric quaternary ammonium salt of the Formula $—\{—CH_2—C—(CH_3)—[C(O)O—CH_2CH_2—N(CH_3)_3]\}_x^+[CH_3SO_4]^-_x$ POLYQUATERNIUM-15 (CAS-Number: 35429-19-7)

Definition: copolymer of acrylamide and β-methacrylyloxyethyltrimethylammonium chloride.

POLYQUATERNIUM-16 (CAS-Number: 95144-24-4)

Definition: polymeric quaternary ammonium salt, formed from methylvinylimidazolium chloride and vinyl pyrrolidone.

POLYQUATERNIUM-17 (CAS-Number: 90624-75-2)

Definition: polymeric quaternary ammonium salt, obtained by reacting adipic acid and dimethylaminopropylamine with dichloroethyl ether.

POLYQUATERNIUM-18

Definition: polymeric quaternary ammonium salt, obtained by reacting azelaic acid and dimethylaminopropylamine with dichloroethyl ether.

POLYQUATERNIUM-19

Definition: polymeric quaternary ammonium salt, obtained by reacting polyvinyl alcohol with 2,3-epoxypropylamine.

POLYQUATERNIUM-20

Definition: polymeric quaternary ammonium salt, obtained by reacting polyvinyl octadecyl ether with 2,3-epoxypropylamine.

POLYQUATERNIUM-21 (CAS-Number: 102523-94-4)

Definition: polysiloxane/polydimethyldialkylammonium acetate copolymer

POLYQUATERNIUM-22 (CAS-Number: 53694-17-0)

Definition: dimethyldiallylammonium chloride/acrylic acid copolymer.

POLYQUATERNIUM-24 (CAS-Number: 107987-23-5)

Definition: polymeric quaternary ammonium salt, obtained by reacting hydroxyethyl cellulose with a lauryldimethylammonium-substituted epoxide.

POLYQUATERNIUM-27

Definition: block copolymer from the reaction of polyquaternium-2 with polyquaternium-17.

POLYQUATERNIUM-28 (CAS-Number: 131954-48-8)

Definition: vinyl pyrrolidone/methacrylamidopropyltrimethylammonium chloride copolymer.

POLYQUATERNIUM-29

Definition: chitosan reacted with propylene oxide and quaternized with epichlorohydrin.

POLYQUATERNIUM-30

Definition: polymeric quaternary ammonium salt of the Formula $—[CH_2C(CH_3)(C(O)OCH_3)]_x—[CH_2C(CH_3)(C(O)OCH_2CH_2N^+(CH_3)_2CH_2COO^-)]_y^-$ POLYQUATERNIUM-31 (CAS-Number. 136505-02-7)

POLYQUATERNIUM-32 (CAS-Number: 35429-19-7)

Definition: polymer of N,N,N-trimethyl-2-[(2-methyl-1-oxo-2-propenyl)oxy]-ethanaminium chloride with 2-propenamide.

POLYQUATERNIUM-37 (CAS-Number: 26161-33-1)

Definition: homopolymer of methacryloyltrimethyl chloride, available for example as Synthalen® CR (from 3V Sigma).

POLYQUATERNIUM-44 (CAS-Number: 150595-70-5)

Definition: quaternary ammonium salt of the copolymer of vinyl pyrrolidone and quaternized imidazoline.

POLYQUATERNIUM-68 (CAS-Number: 827346-45-2)

Definition: quaternized copolymer of vinyl pyrrolidone, methacrylamide, vinyl imidazole and quaternized vinyl imidazole.

Also preferred is that the fabric care composition of the present invention include both a fabric softening compound and one or more additional fabric care compounds.

The amount of fabric care compound in the present composition is from 0.1 wt. % to 15 wt. %, preferably between 2 wt. % and 12 wt. %.

The fabric care composition of the present invention also comprises a water-soluble polymer. Suitable water-soluble polymers preferably have a melting point or softening point in the range 48° C. to 300° C. and may comprise polyalkylene glycols, especially polyethylene glycols, polyethylene terephthalates and/or polyvinyl alcohols. The water-soluble polymers more preferably have a melting point or softening point in the range 48° C. to 120° C.

Melting point is defined as the transition from a solid state into a liquid (free flowing) state. The softening temperature describes the transition from a solid state into a rubber-like to viscous melt. The melting temperature and the softening temperature can each be either a specific temperature or a small range within the range 48° C. to 300° C.

Suitable polyalkylene glycols particularly include polyethylene glycols that are liquid or solid polymers, depending on their chain length. Above a molecular weight of 3000, the polyethylene glycols are solid substances and are commercialized as flakes or powder. Hardness and melting range increase with increasing molecular weight. For the present invention, preferred polyethylene glycols have a mean molecular weight between 3000 and 12,000, more preferably between 4000 and 10,000 and most preferably between 6000 and 8000.

Polyethylene terephthalate is a polyester, commercially available in crystalline (opaque white) as well as amorphous form (transparent). The melting point of crystalline polyethylene terephthalate is ca. 260° C. As a thermoplastic polymer, polyethylene terephthalate can be shaped under heat into nearly all shapes. Moreover, modified polyethylene terephthalates (for example, blends with other polymers or polyethylene terephthalates with other integrated moieties) can be employed.

Polyvinyl alcohols are commercially available as a white-yellowish powder or as granulates with polymerization grades in the range of ca. 500-2500 (molecular masses of ca. 20,000-100,000 g/mol). The degree of hydrolysis ranges from 98-99 or 87-89 mol-% and therefore the polyvinyl alcohols still contain a residual content of acetyl groups. The manufacturers characterize the polyvinyl alcohols by stating the degree of polymerization of the initial polymer, the degree of hydrolysis and/or the saponification number. Fully hydrolyzed polyvinyl alcohols have a softening temperature of 85° C. and a melting point of 228° C. The corresponding values for partially hydrolyzed (87-89%) products are significantly lower at ca. 58° C. (softening point) and 186° C. (melting point).

The water-soluble polymer may also comprise a mixture of these materials discussed. However, it is preferred that the fabric care composition contains a polyalkylene glycol, and especially a polyethylene glycol, as the water-soluble polymer.

The fabric care composition in accordance with the present invention also comprises a perfume. Suitable perfume oils or fragrances include individual odoriferous compounds, for example synthetic products of the ester, ether, aldehyde, ketone, alcohol, and hydrocarbon type. However, mixtures of various odoriferous substances, which together produce an attractive fragrant note, are preferably used. Such perfume oils can also comprise natural mixtures of odoriferous compounds, as are available from vegetal sources.

Preferably the quantity of perfume in the fabric care composition ranges between 0.1 and 15 wt. %, more preferably between 0.5 and 10 wt. %, and most preferably between 1 and 7 wt. %.

As an alternative, it may be preferable that at least part of the perfume is employed in an encapsulated form, especially in microcapsules, in the coating. The microcapsules may be water-soluble and/or water-insoluble microcapsules. As non-limiting examples, melamin-urea-formaldehyde microcapsules, melamin-formaldehyde microcapsules, urea-formaldehyde microcapsules, or starch microcapsules may be employed.

In addition, the fabric care composition in accordance with the present invention comprises a polysaccharide. Suitable exemplary polysaccharides include glycogen, starch, chitin, callose, cellulose, dextran, tunicin, inulin, alginic acid, xanthane, gellan, guar, carob flour, carrageenan, and derivatives of these compounds, and mixtures thereof.

The polysaccharide preferably comprises cellulose or a cellulose derivative, more preferably a cellulose derivative. Suitable examples of cellulose derivatives that find use in the present composition include methyl cellulose, ethyl cellulose, propyl cellulose, methyl ethyl cellulose, carboxymethyl cellulose, ethyl carboxymethyl cellulose, hydroxyethyl cellulose, hydroxypropyl cellulose, carboxymethyl hydroxyethyl cellulose, methyl hydroxyethyl cellulose, hydroxypropyl methyl cellulose, ethyl hydroxyethyl cellulose, methyl ethyl hydroxyethyl cellulose, quaternized cellulose, quaternized cellulose derivatives, amine-modified cellulose, amine-modified cellulose derivatives or mixtures of these compounds. Suitable methyl hydroxypropyl celluloses may be obtained under the trade names Methocel® J 40 MS or Methocel® J 5 S from Dow Chemical. Hydroxyethyl celluloses that can be employed in the present invention include Cellosize® HEC QP (from Dow Chemical). Suitable methyl celluloses include for example Methocel® A (from Dow Chemical). Suitable examples of useful cationic cellulose derivatives include the Polyquaternium-10 compounds Celquat® SC-240 (from National Starch) or UCARE® Polymer JR-125, UCARE® Polymer JR-400, UCARE® Polymer JR-30M, UCARE® Polymer LR 400, UCARE® Polymer LR 30M and Ucare® Polymer SR-10 (all available from Amerchol). Finnfix BDA (from Kelco) may also be used as carboxy methyl cellulose.

In accordance with the present invention, it is preferred that the cellulose or cellulose derivative be incorporated in powdered form.

The ratio of fabric care compound to polysaccharide in the present invention is preferably between 15:1 and 1:5, more preferably between 12:1 and 1:1, and most preferably between 9:1 and 4:1.

The fabric care composition of the present invention may also include a variety of optional ingredients.

For example, in order to enhance the aesthetic impression of the composition itself, the composition may be colored with an appropriate colorant. Preferred colorants are well known to formulators in the art and should have high storage stability, should not be affected by the ingredients delivered from the washing or cleaning agent, or by light, and should not substantively stain textile fibers.

Additionally the fabric care composition may comprise filler, such as silica. The amount of filler may range between 0.1 wt. % and 10 wt. %, preferably from 1 wt. % to 5 wt. %.

In order to increase the gloss, the fabric care composition may also comprise a pearlizer. Examples of suitable pearlizers include ethylene glycol mono- and di-stearate, (for example Cutina® AGS available from Cognis) as well as PEG-3-distearate.

In addition, the fabric care composition may include a skin care compound.

A skin care compound is understood to mean a compound or a mixture of compounds that on contact with a fabric in the laundry is absorbed onto the fabric, and then on contact of the fabric with skin, the compound lends the skin an advantage as compared with a fabric that was not treated with the washing and cleaning agent according to the invention. For example, this advantage can include the transfer of the skin care compound from the fabric onto the skin, a lower water transfer from the skin to the fabric, or a lower friction between the surface of the skin and the fabric.

The skin care compound for use herein is preferably hydrophobic, it can be liquid or solid, and it must be compatible with the other ingredients of the fabric care composition. The skin care compound can contain for example:

a) waxes, such as carnuba, spermaceti, beeswax, lanolin, derivatives thereof as well as their mixtures;

b) plant extracts, for example vegetal oils such as avocado oil, olive oil, palm oil, palm nut oil, rape seed oil, linseed oil, soya oil, peanut oil, coriander oil, castor oil, poppy-seed oil, coconut oil, pumpkin seed oil, wheat germ oil, sesame oil, sunflower oil, almond oil, macadamia nut oil, apricot nut oil, hazel nut oil, jojoba oil or canola oil, aloe vera as well as their mixtures;

c) higher fatty acids, such as lauric acid, myristic acid, palmitic acid, stearic acid, behenic acid, oleic acid, linoleic acid, linolenic acid, isostearic acid or polyunsaturated fatty acids;

d) higher fatty alcohols, such as lauryl alcohol, cetyl alcohol, stearyl alcohol, oleyl alcohol, behenyl alcohol or 2-hexadecanol;

e) esters, such as cetyl octanoate, lauryl lactate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactates, alkyl citrates and/or alkyl tartrates;

f) hydrocarbons, such as paraffins, mineral oils, squalane or squalene;

g) lipids;

h) vitamins, such as vitamin A, C or E or vitamin alkyl esters;

i) phospholipids;

j) sun protection agents, such as octyl methoxycinnamate and butyl methoxybenzoylmethane;

k) silicone oils, such as linear or cyclic polydimethylsiloxanes, amino, alkyl, alkylaryl or aryl-substituted silicone oils; and, l) mixtures thereof.

The quantity of skin care compound for use in the present composition is preferably between 0.01 and 10 wt. %, more preferably between 0.1 and 5 wt. %, and most preferably between 0.3 and 3 wt. %, based on the solid, fabric care composition. It may be the case that the skin care compound also possesses a fabric care effect.

In order to discourage oral consumption of the fabric care composition by humans, especially children, or animals, the composition can comprise a bittering agent such as Bitrex® available from Macfarlan Smith.

These additional ingredients are preferably incorporated into the coating of the water-soluble polymer.

In a preferred embodiment, the solid, fabric care composition of the present invention contains a water-soluble carrier, a water-soluble polymer, a fabric care compound, a polysaccharide and a perfume, wherein the water-soluble carrier is present in particulate form and at least partially possesses a coating of the water-soluble polymer and the perfume, and wherein a mixture of the fabric care compound and the polysaccharide is incorporated into the coating.

To manufacture such a solid, fabric care composition, the water-soluble polymer is first melted and blended in the molten state with the perfume. The resulting melt is then added in such a manner to the particulate carrier that the carrier is at least partially coated, and then a mixture of the fabric care compound and the polysaccharide is incorporated into the still molten coating. In this regard, the mixture is preferably completely incorporated into the coating. However, a possible alternative is that a major part of the mixture of the fabric care compound and the polysaccharide is on the surface of the coating.

In an alternative embodiment, the solid, fabric care composition comprises a water-soluble carrier, a water-soluble polymer, a fabric care compound, a polysaccharide and a perfume, wherein the water-soluble carrier is present in particulate form and at least partially possesses a coating of the water-soluble polymer and the perfume, and wherein the coating or the coating and the uncoated areas of the water-soluble carrier is/are at least partially coated with a mixture of the fabric care compound and the polysaccharide.

To manufacture such a solid, fabric care composition, the water-soluble polymer is first melted and blended in the molten state with the perfume. The resulting melt is then added in such a manner to the particulate carrier that the carrier is at least partially coated, and then the coating, or the coating and the uncoated areas of the water-soluble carrier, is/are at least partially coated with a mixture of the fabric care compound and the polysaccharide.

In both embodiments, the particulate carrier is preferably completely coated.

In general, it is preferred that the fabric care compound is a Bentonite and the polysaccharide is a cellulose derivative. The cellulose derivative is most preferably an N,N,N-trialkylaminohydroxyalkyl-quaternized hydroxyethyl cellulose, an N,N,N-trialkylaminohydroxyalkyl-quaternized hydroxypropyl cellulose, a carboxymethyl cellulose, a methyl hydroxypropyl cellulose, a hydroxyethyl cellulose, an N,N-dialkylaminoalkyl-substituted cellulose derivative, or a methyl cellulose. It is also preferred that both the Bentonite and the polysaccharide are incorporated in powdered form.

The fabric care composition is particularly suitable for conditioning textile fabrics and for this purpose it may be brought into contact, together with a conventional washing or cleaning agent, with the textile fabrics in the (main) wash cycle of a conventional washing and cleaning process.

The fabric care composition may be incorporated into a washing and cleaning agent.

To this end, a solid washing or cleaning agent may be mixed with 1 to 20 wt. %, preferably 5 to 15 wt. %, of the fabric care composition according to the present invention.

In addition to the fabric care composition, the fabric care washing or cleaning agents according to the invention comprise surfactant(s), wherein anionic, non-ionic, cationic, and/or amphoteric surfactants may be employed. Mixtures of anionic and non-ionic surfactants are preferred. The total surfactant content of a washing or cleaning agent in accordance with the present invention is preferably below 40 wt. %, and more preferably below 35 wt. %, based on the total liquid washing or cleaning composition.

Preferred non-ionic surfactants include alkoxylated, (more preferred ethoxylated), primary alcohols containing 8 to 18 carbon atoms and, on average, 1 to 12 moles of ethylene oxide (EO) per mole of alcohol, in which the alcohol group may be linear or methyl-branched in the 2-position, or that may contain e.g. linear and methyl-branched groups in the form of the mixtures typically present in oxo alcohol groups. In particular, however, alcohol ethoxylates with linear alcohol groups of natural origin with 12 to 18 carbon atoms, e.g. from coco-, palm-, tallow- or oleyl alcohol, and an average of 2 to 8 EO per mole alcohol, are preferred.

Additionally, alkyl glycosides, polyhydroxyfatty acid amides, alkoxylated fatty acid alkyl esters, fatty acid alkanolamides, and/or amine oxides may also be used as additional non-ionic surfactants.

The amount of non-ionic surfactants in the washing or cleaning agents of the present invention is preferably 5 to 30 wt. %, more preferably 7 to 20 wt. %, and most preferably from 9 to 15 wt. %, in each case based on the total weight of washing or cleaning agent composition.

Examples of anionic surfactants suitable for use in washing or cleaning agents of the present invention include those of the sulfonate and sulfate type. Preferably, $C_{9-13}$ alkylbenzene sulfonates, olefin sulfonates, i.e. mixtures of alkene- and hydroxyalkane sulfonates and disulfonates, are useful as the surfactants. Alkane sulfonates are also suitable. The esters of α-sulfofatty acids (ester sulfonates), e.g. the α-sulfonated methyl esters of hydrogenated coco-, palm nut- or tallow acids are likewise suitable. Further suitable anionic surfactants are the sulfated fatty acid esters of glycerin. The alkali metal salts and especially the sodium salts of the sulfuric acid half ester of the $C_{12}$-$C_{18}$ fatty alcohol are preferred alk(en)yl sulfates. Sulfuric acid mono-esters derived from straight-chained or branched $C_{7-21}$ alcohols ethoxylated with 1 to 6 moles ethylene oxide are also suitable, for example 2-methyl-branched $C_{8-11}$ alcohols with an average of 3.5 mole ethylene oxide (EO), or $C_{12-18}$ fatty alcohols with 1 to 4 EO.

Further suitable anionic surfactants include the salts of alkylsuccinic acids and the monoesters and/or diesters of sulfosuccinic acid with alcohols, preferably with fatty alcohols and especially ethoxylated fatty alcohols.

Particularly preferred anionic surfactants are soaps. Saturated and unsaturated fatty acid soaps are suitable for use herein, such as the salts of lauric acid, myristic acid, palmitic acid, stearic acid, (hydrogenated) erucic acid and behenic acid, and especially soap mixtures derived from natural fatty acids such as coconut oil fatty acid, palm kernel oil fatty acid, olive oil fatty acid or tallow fatty acid.

Anionic surfactants, including the soaps, may be used in the form of their sodium, potassium or ammonium salts or as soluble salts of organic bases, e.g. mono-, di- or triethanolamine. Preferably, the anionic surfactants are used in the form of their sodium or potassium salts, especially in the form of the sodium salts.

The amount of anionic surfactants in the preferred washing or cleaning agents of the present invention is from 2 to 30 wt. %, more preferably from 4 to 25 wt. %, and most preferably from 5 to 22 wt. %, in each case based on the total weight of the washing or cleaning agent composition. However, when the fabric care composition comprises a cationic polymer, it may be best for the washing or cleaning agent to comprise only non-ionic surfactants.

In addition to the fabric care composition and the surfactants, the washing and cleaning agents may comprise additional ingredients that may further improve the technological and/or esthetic properties of the agents. In the context of the present invention, preferred washing or cleaning agents may additionally comprise one or more materials selected from the group consisting of builders, bleaching agents, bleach activators, enzymes, perfumes, perfume carriers, fluorescence agents, dyes, foam inhibitors, silicone oils, anti-redeposition agents, optical brighteners, graying inhibitors, shrink preventers, anti-crease agents, color transfer inhibitors, antimicrobials, germicides, fungicides, antioxidants, preservatives, corrosion inhibitors, antistats, bittering agents, ironing aids, water-repellents and impregnation agents, swelling and non-skid agents, neutral filler salts, and UV-absorbers, and mixtures thereof.

Silicates, aluminum silicates (particularly zeolites), carbonates, salts of organic di- and polycarboxylic acids, as well as mixtures of these materials, are particularly suitable as builders that may be used in the washings or cleaning agents of the present invention.

The generally known phosphates may also be added as builders in so far as their use is not restricted for ecological reasons.

The sodium salts of the orthophosphates, the pyrophosphates and the tripolyphosphates are particularly suitable herein.

Organic builders that may be used in the washing or cleaning agent include polycarboxylate polymers, such as polyacrylates and acrylic acid/maleic acid copolymers, polyaspartates, and monomeric polycarboxylates, such as citrates, gluconates, succinates or malonates, any of which are preferably added as their sodium salts.

Among the compounds that serve as bleaching agents and liberate $H_2O_2$ in water, sodium perborate tetrahydrate and sodium perborate monohydrate are preferred for use herein. Examples of other bleaching agents that may be employed include sodium percarbonate, peroxypyrophosphates, citrate perhydrates and $H_2O_2$-liberating peracidic salts or peracids, such as perbenzoates, peroxyphthalates, diperoxyazelaic acid, phthaloimino peracids or diperoxydodecanedioic acid.

The washing or cleaning compositions may comprise bleach activators in order to achieve an improved bleaching action for washing temperatures of 60° C. and below. Bleach activators are compounds that under perhydrolysis conditions yield aliphatic peroxycarboxylic acids having preferably 1 to 10 carbon atoms, in particular 2 to 4 carbon atoms, and/or optionally substituted perbenzoic acid. Substances that carry O-acyl and/or N-acyl groups of said number of carbon atoms and/or optionally substituted benzoyl groups are suitable. Preferred are polyacylated alkylenediamines, in particular tetraacetyl ethylenediamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoyl succinimide (NOSI), acylated phenol sulfonates, in particular n-nonanoyl- or isononanoyloxybenzene sulfonate (n- or iso-NOBS), carboxylic acid anhydrides, in particular phthalic anhydride, acylated polyhydric alcohols, in particular triacetin, ethylene glycol diacetate and 2,5-diacetoxy-2,5-dihydrofuran.

In addition to, or instead of the conventional bleach activators, so-called bleach catalysts may also be incorporated into the washing or cleaning agents of the present invention. These substances are bleach-boosting transition metal salts or transition metal complexes such as, for example, manganese-, iron-, cobalt-, ruthenium- or molybdenum-salen or -carbonyl complexes. Manganese, iron, cobalt, ruthenium, molybdenum, titanium, vanadium and copper complexes with nitrogen-containing tripod ligands and cobalt-, iron-, copper- and ruthenium-amine complexes may also be used as bleach catalysts.

The washing or cleaning agent of the present invention may also comprise encapsulated enzymes and/or enzymes. Suitable enzymes include those from the classes of the hydrolases, such as proteases, esterases, lipases or lipolytic enzymes, amylases, cellulases or other glycosyl hydrolases, hemicellulases, cutinases, β-glucanases, oxidases, peroxidases, mannanases, perhydrolases and/or laccases and mixtures thereof. Enzymatic active materials obtained from bacterial sources or fungi such as *bacillus subtilis, bacillus licheniformis, streptomyceus griseus* and *humicola insolens* are particularly well suited. Mixtures of enzymes are of particular interest, for example proteases and amylases or proteases and lipases or lipolytic enzymes or proteases and cellulases or cellulases and lipases or lipolytic enzymes or proteases, amylases and lipases or lipolytic enzymes or proteases, lipases or lipolytic enzymes and cellulases, in particular, however, proteases and/or lipase-containing mixtures or mixtures with lipolytic enzymes. Examples of such lipolytic enzymes are the known cutinases. Peroxidases or oxidases have also proved to be suitable in certain cases. Suitable amylases include□ α-amylases, iso-amylases, pullulanases and pectinases. Cellobiohydrolases, endoglucanases and β-glucosidases or mixtures thereof, which are also known as cellobiases, are preferred cellulases. As the different cellulase types differ in their CMCase- and avicelase activities, the required activities can be adjusted by means of controlled mixtures of the cellulases.

The enzymes may be adsorbed on carriers in order to protect them against premature decomposition. The amount of enzymes, enzyme mixtures, or enzyme granules directly incorporated in the washing or cleaning agent may be from about 0.01 wt. % to 5% wt. %, preferably 0.12 wt. % to about 2.5% wt. %.

However, for preparation of washing or cleaning agents marketable to consumers with allergies and/or sensitive skin, the enzymes may be left out from the composition.

In another exemplary embodiment of the present invention, the washing or cleaning agent may optionally comprise one or a plurality of perfumes, normally in an amount of up to 10 wt. %, preferably 0.5 to 7 wt. %, and more preferably from 1 to 3 wt. %. Here, the amount of added perfume also depends on the type of the washing or cleaning agent. However, it is particularly preferred that the perfume is incorporated into the washing or cleaning agent through the fabric care composition. However, it is also possible that the washing or cleaning agent comprises perfume that has not been incorporated into the washing or cleaning agent through the fabric care composition.

The washing or cleaning agents may be wholly or partially colored with appropriate colorants in order to enhance the aesthetic appeal of the compositions. Preferred colorants are well known by formulators in the art, and are normally chosen on the basis of storage stability, compatibility with the other ingredients within the washing or cleaning agent, light stability, and lack of staining of textile fibers.

Soaps, paraffin or silicone oils, may be optionally deposited on carrier materials as foam inhibitors for the washing or cleaning agents in accordance with the present invention.

Suitable anti-redeposition agents, also referred to as soil repellents, are for example non-ionic cellulose ethers such as methyl cellulose and methyl hydroxypropyl cellulose with a content of methoxy groups of 15 to 30 wt. % and hydroxypropyl groups of 1 to 15 wt. %, each based on the non-ionic cellulose ether, as well as polymers of phthalic acid and/or terephthalic acid or their derivatives known from the prior art, particularly polymers of ethylene terephthalates and/or polyethylene and/or polypropylene glycol terephthalates or anionically and/or non-ionically modified derivatives thereof. Suitable derivatives include the sulfonated derivatives of the phthalic acid polymers and the terephthalic acid polymers. Modified alkoxylated and/or quaternized and/or oxidized polyamines represent a further class of suitable soil release polymers, particularly useful for cotton-containing fabrics. Useful polyamines include polyalkyleneamines such as polyethyleneamines, or polyalkyleneimines such as polyethyleneimines. Preferred examples of this class of soil release polymers are ethoxylated polyethyleneimines and ethoxylated polyethyleneamines.

Optical brighteners (so called "whiteners") may be added to the washing or cleaning agents of the present invention in order to eliminate graying and yellowing of the treated textile fabrics. These materials absorb onto the fibers causing a brightening and pseudo bleach effect such that the invisible ultraviolet radiation is converted into visible radiation, wherein the ultraviolet light absorbed from sunlight is irradiated away as weak blue fluorescence resulting in pure white for the yellow shade of the grayed or yellowed washing. Suitable exemplary compounds derive from the substance classes of the 4,4'-diamino-2,2'-stilbenedisulfonic acids (flavonic acids), 4,4'-distyrylbiphenylene, methylumbelliferone, coumarone, dihydroquinolinones, 1,3-diarylpyrazolines, naphthoic acid imides, benzoxazole-, benzisoxazole- and benzimidazole-systems as well as the heterocyclic substituted pyrene derivatives. The optical brighteners are usually added in amounts between 0% and 0.3 wt. %, based on the total weight of the finished washing or cleaning agent composition.

Graying inhibitors maintain suspension of the dirt removed from the fibers, thereby preventing the dirt from resettling on the fabrics in the wash liquor. Water-soluble colloids of mostly organic nature are suitable for this purpose. Exemplary materials include, but are not limited to, glues, gelatins, salts of ether sulfonic acids of starches or celluloses, or salts of acidic sulfuric acid esters of celluloses or starches. Water-soluble, acid group-containing polyamides are also suitable for this purpose. In addition, soluble starch preparations and others can be used as the above-mentioned starch products, for example degraded starches, aldehyde starches etc. Polyvinyl pyrrolidone may also be used. It is preferred to use cellulose ethers such as carboxymethyl cellulose (Na salt), methyl cellulose, hydroxyalkyl cellulose and mixed ethers such as methyl hydroxyethyl cellulose, methyl hydroxypropyl cellulose, methyl carboxymethyl cellulose and mixtures thereof, at amounts of 0.1 to 5 wt. %, based on the total weight of the washing or cleaning agent composition.

In order to efficiently mitigate color dissolution from fabrics and/or the dye transfer to other textiles during the washing and/or cleaning of colored fabrics, the washing or cleaning agents of the present invention may comprise a color transfer inhibitor. The color transfer inhibitor is preferably a polymer or copolymer of cyclic amines. As color transfer inhibitors, suitable polymers include polyvinyl pyrrolidone (PVP), polyvinylimidazole (PVI), copolymers of vinyl pyrrolidone and vinylimidazole (PVP/PVI), polyvinylpyridine-N-oxide, poly-N-carboxymethyl-4-vinylpyridium chloride as well as mixtures thereof.

The amount of color transfer inhibitor based on the total weight of the washing or cleaning agent is preferably 0.01 to 2 wt. %, more preferably from 0.05 to 1 wt. %, and most preferably from 0.1 to 0.5 wt. %.

Alternatively, enzymatic systems that include a peroxidase and hydrogen peroxide, or a substance that generates hydrogen peroxide in water, may also be added as the color transfer inhibitor. The addition of a mediator compound for the peroxidase, for example, an acetosyringone, a phenol derivative or a phenothiazine or phenoxazine, is preferred in this case, wherein in addition, the above-mentioned polymeric color transfer inhibitors may also be used.

Because some textile fabrics such as rayon, spun rayon, cotton and their mixtures, tend to crease because the individual fibers are sensitive to deflection, bending, pressing and squeezing at right angles to the fiber direction, the washing or cleaning agents herein may comprise synthetic anti-crease agents. Exemplary materials include synthetic products based on fatty acids, fatty acid esters, fatty acid amides, fatty acid alkylol esters, fatty acid alkylol amides or fatty alcohols that have mainly been treated with ethylene oxide, or products based on lecithin or modified phosphoric acid esters.

The washing or cleaning agents of the present invention may comprise antimicrobial agents to control microorganisms. Depending on the antimicrobial spectrum and the mechanism of action, antimicrobial agents are classified as bacteriostatic agents and bactericides, fungistatic agents and fungicides, etc. Important representatives of these groups are, for example, benzalkonium chlorides, alkylaryl sulfonates, halophenols and phenol mercuric acetate, wherein these compounds can also be totally dispensed with in the inventive washing or cleaning agents.

The washing or cleaning agents of the present invention may also comprise preservatives. Preferably only those are preservatives are used that have no, or only slight, skin sensitizing potential. Examples are sorbic acid and its salts, benzoic acid and its salts, salicylic acid and its salts, phenoxyethanol, 3-iodo-2-propynylbutyl carbamate, sodium N-(hydroxymethyl)glycinate, biphenyl-2-ol as well as mixtures thereof. A suitable preservative is illustrated by the solvent-free, aqueous combination of diazolidinyl urea, sodium benzoate and potassium sorbate (obtainable as Euxyl® K 500 from Schuelke & Mayr), which can be employed in a pH range of up to 7.

The washing and cleaning agents may also comprise antioxidants to prevent undesirable changes caused by oxygen and other oxidative processes to the washing or cleaning agents and/or to the treated textile fabrics. This class of compounds includes, for example, substituted phenols, hydroquinones, pyrocatechols and aromatic amines, as well as organic sulfides, polysulfides, dithiocarbamates, phosphites, phosphonates and vitamin E.

An increase in comfort when wearing treated fabrics may result from the additional use of antistats in the washing or cleaning agents herein. These mainly interfacially active antistats can be subdivided into nitrogen-containing (amines, amides, quaternary ammonium compounds), phosphorus-containing (phosphoric acid esters) and sulfur-containing (alkyl sulfonates, alkyl sulfates) antistats.

Silicone derivatives may be incorporated in the washing or cleaning agent to improve the re-wettability of the treated textile fabrics and to facilitate ironing of the treated textile fabrics. By their foam-inhibiting properties, they also improve the final rinse behavior of the washing or cleaning agent.

The washing or cleaning agents may also comprise UV absorbers. Suitable compounds include benzophenone with substituents in the 2- and/or 4-position, or substituted benzotriazoles.

Heavy metal chelants may be added to the washing or cleaning agents of the present invention to complex heavy metals and mitigate the heavy metal catalyzed decomposition of certain washing ingredients. Suitable heavy metal sequestrants are, for example, the alkali salts of ethylene diamine tetraacetic acid (EDTA) or nitrilotriacetic acid (NTA), as well as the alkali metal salts of anionic polyelectrolytes such as polyacrylates, polymaleates, and polysulfonates. The phosphonates are a preferred class of sequestrants. Preferred compounds include organophosphonates, such as 1-hydroxyethane-1,1-diphosphonic acid (HEDP), amino tri(methylenephosphonic acid) (ATMP), diethylenetriamine penta(methylenephosphonic acid) (DTPMP or DETPMP) as well as 2-phosphonobutane-1,2,4-tricarboxylic acid (PBS-AM), which are mainly added in the form of their ammonium or alkali metal salts.

In addition, the solid washing or cleaning agents herein may comprise neutral filler salts such as sodium sulfate or sodium carbonate.

The washing or cleaning agents herein discloses are particularly useful for the cleaning and conditioning of textile fabrics.

The washing or cleaning agents of the present invention may be manufactured without the fabric care composition using known methods that may include for example drying steps, mixing steps, densification steps, molding steps and/or the subsequent addition of heat-sensitive ingredients (post addition). The resulting product may be subsequently blended with a solid, fabric care composition. For manufacturing molded bodies of the washing or cleaning agents, additional densification and/or molding steps can follow the mixing step.

Exemplary embodiments of the fabric care compositions in accordance with the present invention are shown in TABLE 1.

TABLE 1

Fabric Care Compositions

| Ingredient | V1 | E1 | E2 | E3 | E4 |
|---|---|---|---|---|---|
| Sucrose crystals (1 to 4 mm) | 69.99 | 69.99 | 69.99 | 69.99 | 69.99 |
| Bentonite (powder) | 10 | 9 | 9 | 9 | 9 |
| Methyl hydroxypropyl cellulose* | — | 1 | — | — | — |
| Hydroxyethyl cellulose* | — | — | 1 | — | — |
| Methyl cellulose* | — | — | — | 1 | — |
| Cationic hydroxyethyl cellulose* | — | — | — | — | 1 |
| Perfume | 5 | 5 | 5 | 5 | 5 |
| PEG 8000 | 15 | 15 | 15 | 15 | 15 |
| Colorant (blue) | 0.01 | 0.01 | 0.01 | 0.01 | 0.01 |

*The cellulose derivatives were all added in powder form.

For manufacturing the compositions E1 to E4 in Table 1, the polyethylene glycol with mean molecular weight of 8000 (PEG 8000) was melted and both the perfume and the colorant were added to the melt. The resulting colored melt was then added to the sucrose crystals. With continued stirring of the crystals, and while the applied melt was still not completely solidified, the sucrose crystals were dusted with a mixture of Bentonite powder and cellulose derivative powder.

The freshly produced compositions E1 through E4 showed better flow than the reference composition V1. Furthermore, each of the freshly prepared compositions E1 through E4 possessed a clear, crystalline visual appearance.

In comparison, fabric care composition V1 began to lose its transparent appearance after 4-weeks storage at room temperature. After 8-weeks storage, the V1 crystals completely lost their transparent appearance and even exhibited a significant change in color.

On the other hand, fabric care compositions E1 through E3 (comprising methyl hydroxypropyl cellulose, methyl cellulose, and hydroxyethyl cellulose, respectively) showed transparent appearance and no detectable change in color after 8-weeks storage. Even after 12-weeks storage at room temperature, the methyl cellulose and hydroxyethyl cellulose containing compositions (E2, E3 respectively) still exhibited a clear transparent and crystalline appearance, without any detectable change in color. The hydroxyethyl cellulose-containing fabric care composition E3 proved to be particularly stable in regard to its transparency and after 24 weeks it still exhibited a clear, transparent crystalline appearance. Moreover, the crystals E3 still showed no change in color at all after 24 weeks. After 8 weeks storage at room temperature the fabric care composition E4 also showed a transparent appearance, but a slight tendency to form small aggregates was also observed.

The fabric care compositions E1 through E4 showed very good dissolution behavior in water, and in comparison with water as a reference, showed a softening effect on textile fabrics. Moreover, the fabric care compositions E1 to E4 showed significantly higher fragrance intensity on damp, freshly washed laundry in comparison with laundry treated with a conventional liquid, esterquat-containing conditioner.

Additional fabric care compositions in accordance with the present invention are shown in TABLE 2, including the formulation V2 for comparison.

TABLE 2

Additional Fabric Care Compositions

| Ingredient | V2 | E5 | E6 | E7 | E8 |
|---|---|---|---|---|---|
| Sucrose crystals (1 to 4 mm) | 69.99 | 69.99 | 69.99 | 69.99 | 69.99 |
| Bentonite (powder) | 10 | 9.5 | 9 | 8 | 9.5 |
| Carboxymethyl cellulose, Na salt* | — | 0.5 | 1 | 2 | — |
| Amine substituted cellulose derivative* | — | — | — | — | 0.5 |
| Perfume | 5 | 5 | 5 | 5 | 5 |
| PEG 8000 | 15 | 15 | 15 | 15 | 15 |
| Colorant (blue) | 0.01 | 0.01 | 0.01 | 0.01 | 0.01 |

*The cellulose derivatives were all added in powder form.

To manufacture the fabric care compositions E5 through E7 shown in Table 2, the polyethylene glycol with mean molecular weight of 8000 (PEG 8000) was melted and both the perfume and the colorant were added to the melt. The resulting colored melt was then added to the sucrose crystals. With continued stirring of the crystals, and while the applied melt was still not completely solidified, the sucrose crystals were dusted with a mixture of Bentonite powder and cellulose derivative powder.

The freshly produced compositions E5 through E7 in Table 2 possessed a transparent crystalline appearance. In comparison, the fabric care composition V2 began to lose transparency after 4-weeks storage at room temperature. After 8-weeks storage at room temperature, the V2 crystals had completely lost their transparent appearance and exhibited significant change in color.

The fabric care composition E5 in accordance with the present invention also showed a loss in transparency after 4-weeks storage. However, the observed loss in transparency was less than that observed for the reference fabric care composition V2. Both of the fabric care compositions E6 and E7 of the present invention also remained transparent and color-stable after 8 weeks storage, whereas the reference composition V2 had completely changed its color and lost its transparency. The inventive fabric care composition E5 showed a further slight loss in transparency and a slight change in color after 8 weeks storage.

A particularly color-stable fabric care composition was E8 shown in Table 2. A pleasing crystalline appearance was obtained when dimethyl aminoethyl hydroxyethyl cellulose was used as the polysaccharide in accordance with the present invention.

For manufacturing composition E8 shown in Table 2, the polyethylene glycol with mean molecular weight of 8000 (PEG 8000) was melted and both the perfume and the colorant were added to the melt. The resulting colored melt was then added to the sucrose crystals. With continued stirring of the crystals, and while the applied melt was still not completely solidified, the sucrose crystals were dusted with a mixture of Bentonite powder and cellulose derivative powder.

Even after 20-weeks of storage, the fabric care composition E8 in accordance with the present invention was still crystal clear, and did not show any change in color.

At the completion of the manufacturing of fabric care compositions E1 through E8 in accordance with the method discussed above, the compositions could be filled at significantly higher final temperatures compared to the reference products V1 and V2. Moreover, the fabric care compositions of the present invention, especially E1, E2, E3, E5, E6, E7, and E8, did not show any clumping or agglomerating tendency, either during manufacture or during storage. The tendency to agglomerate during the storage of the fabric care composition E4 was only low, and the low agglomeration had no negative impact on handling or in dosing the fabric care composition E4.

Washing or cleaning agents in accordance with the present invention were manufactured by mixing a solid, unperfumed washing or cleaning agent with 15 wt. % of the fabric care composition E3 (based on the total amount of finished washing or cleaning agent).

The washing or cleaning agent prepared in accordance with the present invention showed good cleaning and conditioning properties.

Lime scale deposits on the laundry, and/or deposits/residues in the dispensing drawer of the washing machine, were not observed, either for separate application of the fabric care composition or when incorporated the fabric care composition in a washing or cleaning agent. Moreover, the solid, fabric care compositions retained their color and their crystalline appearance.

We claim:

1. A method of manufacturing a dry granular fabric care composition comprising the steps of:

a. providing dry granular water-soluble carrier particles selected from the group consisting of inorganic alkali metal salts, organic alkali metal salts, inorganic alkaline earth metal salts, organic alkaline earth metal salts, organic acids, carbohydrates, silicates, and urea, and mixtures thereof;

b. melting a water-soluble polymer;

c. adding a perfume to said melted polymer to form a molten mixture;

d. mixing said molten mixture with said carrier particles to form at least a partial coating on said particles;

e. forming a dry mixture comprising a polysaccharide and a fabric care substance;

f. dusting said coated particles with said dry mixture while said coating remains at least partially molten.

* * * * *